US006454929B1

(12) United States Patent
Thiele et al.

(10) Patent No.: US 6,454,929 B1
(45) Date of Patent: Sep. 24, 2002

(54) PROCESS FOR THE SIMULTANEOUS ELECTROCHEMICAL PREPARATION OF SODIUM DITHIONITE AND SODIUM PEROXODISULFATE

(75) Inventors: Wolfgang Thiele; Knut Wildner, both of Eilenburg; Hermann Matschiner, Halle; Michael Gnann, Deisenhofen, all of (DE)

(73) Assignee: Eilenburger Elektrolyse- und Umwelttechnik GmbH, Eilenburg (DE)

( * ) Notice: Subject to any disclaimer, the term of this patent is extended or adjusted under 35 U.S.C. 154(b) by 0 days.

(21) Appl. No.: 09/845,021

(22) Filed: Apr. 27, 2001

(51) Int. Cl.[7] ..... C25B 1/28
(52) U.S. Cl. ..... 205/471; 205/472; 205/495
(58) Field of Search ..... 205/471, 472, 205/495

(56) References Cited

U.S. PATENT DOCUMENTS 3,920,551 A 11/1975 Cook, Jr. et al.
6,214,197 B1 * 4/2001 Kimizuka et al. ..... 205/472

FOREIGN PATENT DOCUMENTS

DE 199 54 299 A1 5/2001
WO WO-97 07262 A 2/1997

* cited by examiner

*Primary Examiner*—Arun S. Phasge
(74) *Attorney, Agent, or Firm*—Fulbright & Jaworski, L.L.P.

(57) ABSTRACT

A process for the simultaneous preparation of sodium peroxodisulfate and sodium dithionite in an electrolysis cell divided into two by a cation exchanger membrane, wherein sodium dithionite is produced at the cathode and sodium peroxodisulfate is produced at the anode.

12 Claims, 1 Drawing Sheet

PROCESS FOR THE SIMULTANEOUS ELECTROCHEMICAL PREPARATION OF SODIUM DITHIONITE AND SODIUM PEROXODISULFATE

Nowadays, combined processes with oxidizing and reducing bleaching sequences are increasingly used for various chlorine-free bleaching processes, in particular in the bleaching of paper and pulp. Here, the reducing bleach is preferably sodium dithionite, and the oxidizing bleach is hydrogen peroxide. It has also been suggested to use peroxodisulfates or peroxomonosulfates, which can be prepared electrochemically, as oxidizing bleaches (German patent 198 03 001). Peroxodisulfates are exclusively prepared by electrochemical means (J. Balej, H. Vogt Electrochemical Reactors. In: Fortschritte der Verfahrenstechnik, vol. 22, p. 361, VDI Verlag 1984).

Using an electrochemical combination process it is possible to prepare sodium peroxodisulfate, in addition to sodium hydroxide solution, from sodium sulfate in a two-chamber cell with cation exchanger membranes as separators (EP 0846 194).

The use of an alkaline solution with a stoichiometric composition of sodium peroxodisulfate and sodium hydroxide solution has also been proposed for bleaching and oxidation processes (German patent 44 30 391).

In contrast, the sodium dithionite, which, apart from being used as a bleach in the textile and paper industry, is also used as a dyeing and printing auxiliary, is preferably prepared by chemical processes (W. Brückner, R. Schliebs, G. Winter, K.-H. Büschel; Industrielle anorganische Chemie. Weinheim: Verlag Chemie 1986). Dithionites are obtained industrially by reducing sulfur dioxide with zinc, with sodium formate in a pressurized reaction or with sodium tetrahydroborate. The cathodic reduction of sulfur dioxide also leads to dithionite. However, on an industrial scale it has to date been possible to adopt only an indirect electrolysis process in which sodium amalgam is used as reducing agent (Ullmanns Encyclopedia of Industrial Chemistry, Vol. A 25, pp. 483–484, Weinheim 1994). However, because of the ecotoxicological hazard potential of mercury salts, this process is no longer popular.

The direct cathodic reduction of sulfite or hydrogensulfite ions has not hitherto achieved industrial importance. This is essentially attributed to the fact that as the electrolysis time increases, a considerable loss in yield arises since the dithionites decompose to form thiosulfate and disulfate ions. The higher the temperature and the higher the proton concentration, the more rapid this reaction. For this reason, it has been recommended to use internal and external cooling systems to keep the electrolyte temperature below 20° C. during electrolysis, or to reduce the cathodic current volume to minimize the residence time of the dithionites in the electrode gap (German patent 2646825).

U.S. Pat. No. 3,920,551 proposes the coupling of the dithionite preparation with the chlorine production in order, in this way, to utilize both the cathode process and the anode process. Despite the high selectivity of the ion exchanger membranes which are nowadays available, it is not possible to prevent chloride ions passing into the cathode cycle during the electrolysis process. This proves to be problematical since for many applications chloride-free dithionite is required.

To meet these requirements, it has been proposed to use a three-chamber cell (U.S. Pat. No. 3,905,879). Compared with two-chamber cells, three-chamber cells have the disadvantage that the middle chamber causes an additional loss of voltage. Furthermore, apart from a cation exchanger membrane, an anion exchanger membrane is required; the latter is relatively oxidation-sensitive, which may mean that the membrane needs to be changed more frequently. Apart from the higher operating costs associated therewith, the procurement costs for a three-chamber cell are also significantly higher compared with a simply constructed two-chamber cell.

The problem underlying the invention was to simultaneously prepare sodium dithionite and peroxodisulfate by electrochemical means and with good efficiency.

In this process, sodium peroxodisulfate is prepared at the anode and sodium dithionite is prepared at the cathode in one or more electrolysis cells divided into two by a cation exchanger membrane and having anodes made of polished platinum or valve metals niobium, tantalum, titanium or zirconium coated with platinum or diamond, and cathodes made of carbon, stainless steel, silver or materials coated with platinum metals at current densities of from 1.5 to 6 $kA/m^2$ and temperatures of from 20 to 60° C. In the process, sodium sulfate and water are passed to the anolyte circulating via the anode chambers. The sodium ions liberated at the anode pass through the cation exchanger membrane into the cathode chamber. By introducing sulfur dioxide, water and optionally sodium bisulfite into the catholyte circulating via the cathode chambers, a pH in the range from 4 to 6 is established.

Here, it is possible to prepare the important base chemicals sodium peroxodisulfate and sodium dithionite in crystalline form from the chemicals sodium sulfate and sulfur dioxide, which are produced in many industrial processes as waste products or coupling products, or a sulfuric acid and bisulfite solution.

Compared with the sole electrochemical preparation of sodium peroxodisulfate or sodium dithionite, the electrolysis stream is utilized twice, as a result of which both the specific plant costs—based on the sum of the products obtained—and also the continuous operating costs and here in particular the specific power consumption is markedly reduced.

Compared with the known electrochemical combination process of the cathodic dithionite preparation with the simultaneous evolution of chlorine at the anode, there is no contamination of the dithionite by chlorides. In addition, handling from a processing viewpoint is easier compared with the combination with evolution of chlorine.

The two electrode processes are coupled by the $Na^+$ ions transferred from the anode chamber to the cathode chamber, as arises from the two simplified equations for the main electrode reactions:

$$\text{Anode reaction: } 2Na_2SO_4 - 2e \rightarrow Na_2S_2O_8 + 2Na^+$$

$$\text{Cathode reaction: } 2SO_2 + 2Na^+ + 2e \rightarrow Na_2S_2O_4$$

However, since the release of $Na^-$ ions as a result of the anode reaction, their conversion by the cation exchanger membrane and, finally, the consumption of $Na^+$ ions as a result of the cathode reaction depend on entirely different influences, the sodium balances have to be balanced via the substance streams to be metered into the two electrolyte solutions.

If the current efficiency of the dithionite formation is greater than the conversion of sodium ions, the anolyte is depleted in sodium ions, despite maintaining the prechosen pH, resulting in a reduction in the current efficiency of the dithionite formation. In this case, by metering in additional sodium sulfite or sodium bisulfite, or else sodium hydroxide solution into the catholyte cycle, it is possible to establish the required overall concentration of sodium ions.

Surprisingly, we have found that the acid-catalyzed dissociation reaction of the dithionite ions can also be largely suppressed at relatively high electrolyte temperatures if the pH of from 4 to 6 in the catholyte is maintained at a high $SO_2$ concentration.

Therefore, by introducing sulfur dioxide during the electrolysis, for example using a gas diffusion cathode, by means of a high-performance gas jet or by adding liquid sulfur dioxide, a depletion of sulfur dioxide in the catholyte is avoided.

If these conditions are maintained, the electrolysis can also be operated at temperatures up to 50° C. without resulting in noteworthy dissociation of the dithionite ions formed, and thus a reduction in the current efficiency.

Preferably, average residence times of the sodium dithionite formed in the catholyte cycle of less than 30 min should be aimed at. This is possible by minimizing the amount of catholyte circulating in the overall catholyte cycle.

In order to realize an optimum mass transport to and from the electrode surface, the relative rate of the catholyte along the cathode should be at least 0.1 m/s, wherever possible 0.3 to 0.5 m/s. Since similar flow rates and residence times are also favorable for the formation of peroxodisulfate at the anode, it is advantageous that the two electrolyte circulation systems are constructed approximately symmetrically, and are combined with an approximately identical pressure build-up in the two electrode chambers with only slight pressure differences between the cation exchanger membrane.

At sites where sulfur dioxide is not available in gaseous form or where the use of liquid sulfur dioxide is not desired or not possible, the two starting materials may be generated in situ in an upstream chemical reactor by reacting sodium bisulfite with sodium sulfite with sulfuric acid:

$$Na_2S_2O_5+H_2SO_4 \rightarrow Na_2SO_4+2SO_2+H_2O$$

$$Na_2SO_3+H_2SO_4 \rightarrow Na_2SO_4+SO_2+H_2O$$

For this, it is also possible to use the industrially available bisulfite lye. It is advantageous to keep the residual content of sulfur dioxide in the sodium sulfate solution formed as low as possible by stripping with water vapor in order to be able to introduce said solution directly into the anolyte.

In the case of the use of sulfite solutions, only approximately half of the amount of sodium sulfate required for the overall process is formed. The other half can be added in solid form. This has the advantage that, as a result of subsequent dissolution during the electrolysis, the consumption of sodium sulfate can be balanced, and the high sulfate concentration required for a high current efficiency of the peroxodisulfate formation can be maintained.

In the case of the anodic formation of peroxodisulfates at anodes made of polished platinum, optimum current efficiencies are achieved at high current densities of from 4 to 7 $kA/m^2$, while in the case of the dithionite preparation, lower current densities are more favorable. By establishing a ratio of the electrochemically effective cathode surface area to the anodically effective platinum surface area of 1:1–4, an adaptation to the most favorable conditions for the two reactions is possible. For this, either some of the platinum surface can be covered by masks made of, for example, tantalum, or the platinum surface is divided in the form of gauze electrodes or strip electrodes in such a way that despite the relatively low anode surface area, an extremely homogeneous current density distribution is achieved.

This procedure has the advantage, inter alia, that the current density in the cathode chamber and in the cation exchanger membrane is lower than that at the anode and in the adjacent anode chamber, as a result of which the voltage drop and thus the specific power consumption is markedly reduced despite the required high anodic current densities.

To achieve maximum current efficiencies of the peroxodisulfate formation, it is necessary to add potential-increasing additives, in particular sodium thiocyanate, to the anolyte. However, other known electrolysis additives, such as, for example, sodium cyanamide, thiourea, fluoride, chloride etc. can also advantageously be used in this combination process.

To stabilize the dithionite and/or to maintain the desired pH, it is also possible to add suitable additives to the catholyte, such as, for example, phosphoric acid and/or phosphates.

The aqueous solutions of sodium dithionite and sodium peroxodisulfate obtained, which in addition also contain sulfite or sodium sulfate and sulfuric acid, can be worked up in a known manner to give the crystalline solid end products, it being possible to return the mother liquors from the crystallization processes to the electrolyte cycles.

In many cases, it is, however, also favorable to use the resulting solutions directly or following crystallization from bisulfite and/or sodium sulfate, as reducing and oxidizing bleaches.

The combined use of the two electrolysis products for oxidizing and reducing bleaching sequences, e.g. in the case of the bleaching of pulp, is particularly advantageous. Sodium sulfate which reforms in the process can be separated off and returned to the combined electrolysis process.

WORKING EXAMPLE

Figure 1:
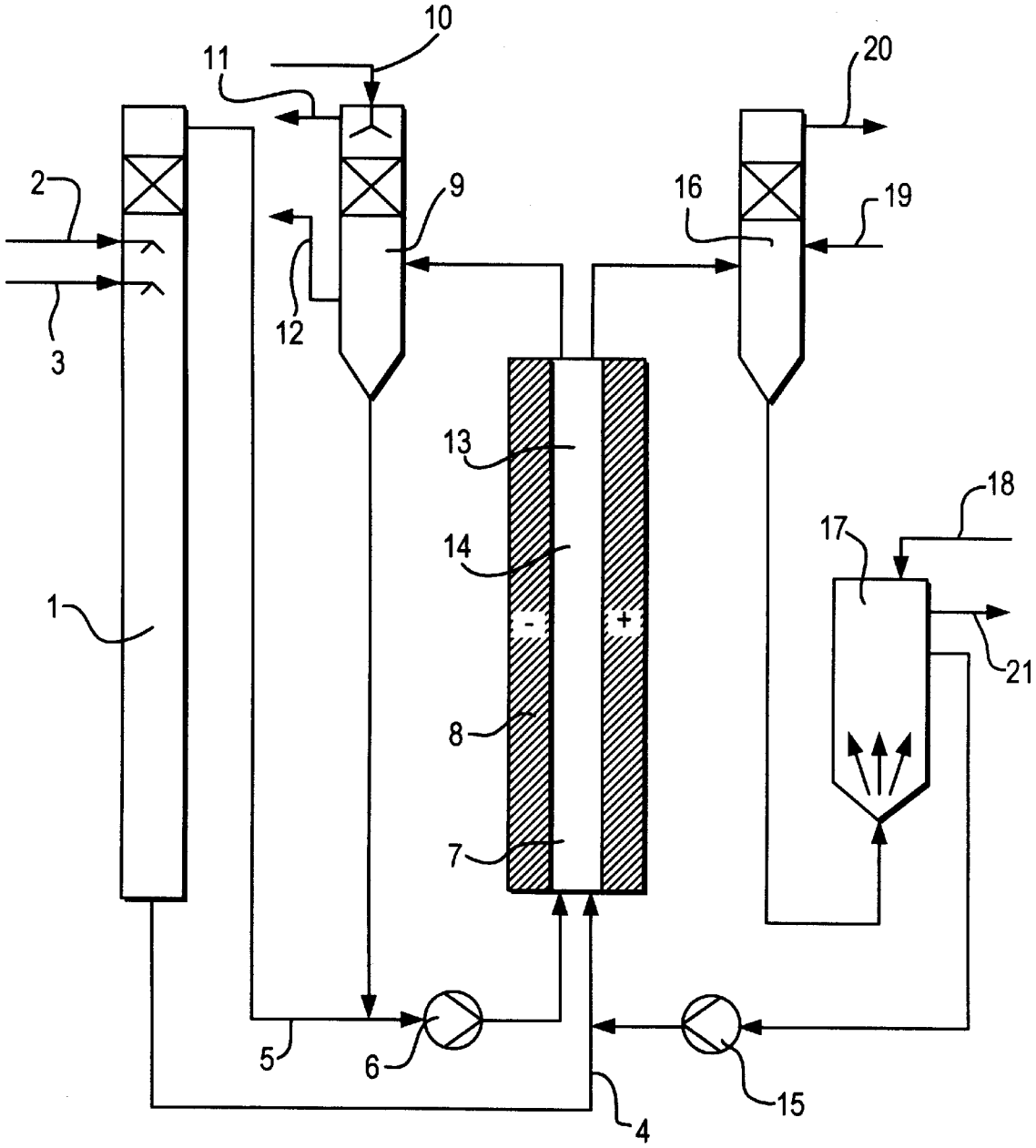
FIG. 1 shows the flow diagram of an exemplary electrolysis plant with preliminary reactor for the in-situ preparation of sulfur dioxide and sodium sulfate from bisulfite lye. In the preliminary reactor 1, sulfuric acid is metered in at 2 and bisulfite lye is metered in at 3 in a quantitative ratio such that, on the one hand, the amount of sulfur dioxide consumed in the process is formed and, on the other hand, the sodium present is converted virtually completely into sodium sulfate. The virtually concentrated sodium sulfate solution produced at the foot of the reactor is introduced, as indicated by 4, into the anolyte cycle, and the sulfur dioxide emerging at the top of the reactor is fed, indicated by 5, into the catholyte cycle.

The catholyte is circulated using a circulation pump 6 through the cathode chambers 7 of the electrolysis cell 8 and the gas separator 9. At 10, the amount of water required to achieve the desired end concentration is metered in to the catholyte cycle. At 11, the separated-off anode gas escapes, and at 12 an amount of a catholyte corresponding to the amount of liquid introduced, enriched with sodium dithionite, passes over. The cathode chamber is separated from the anode chamber 14 by the cation exchanger membrane 13. The anolyte is circulated using a circulation pump 15 via the anode chambers and the gas separator 16 and the dissolution vessel 17. In the dissolution vessel, crystalline sodium sulfate is added at 18 to saturate the anolyte. At 19 the potential-increasing electrolysis additive is metered in, and at 20 the separated-off anode gas emerges. The sodium peroxodisulfate solution formed discharges from the overflow of the dissolution vessel 21.

EXAMPLE 2

The small-pilot-scale experimental plant of Example 1 was modified by omitting the preliminary reactor. Anolyte and catholyte were circulated through the electrode chambers of the electrolysis cell and through the gas separators. The anolyte cycle additionally included the sodium sulfate dissolving vessel depicted in FIG. 1. A metering pump was used to meter deionized water containing an addition of sodium thiocyanate (as potential-increasing additive) into the anolyte cycle. In addition, solid anhydrous sodium sulfate was metered into the dissolving vessel. The catholyte cycle was fed with gaseous sulfur dioxide from a gas cylinder and with a sodium sulfite solution by means of a metering pump. The sodium sulfite served to make good a deficiency of sodium compounds in the cathode chamber due to the reduced transfer of sodium ions from the anode chamber into the cathode chamber. The sulfur dioxide was metered in to regulate the pH to about 5.8. This provided for optimum adjustment of the $SO_2$ feed rate to the sodium ion transfer rate.

The electrolysis cell used was a bipolar filter press electrolysis cell as used for peroxodisulfate ether production and as described in DE 44 196 83. It consisted of a clamping frame holding three electrode plates, namely two edge plates with current supply and a bipolar electrode plate in the middle. This accordingly constituted two electrolysis cells, which were connected in series in electrical terms and were connected in parallel with regard to the electrolyte flows. The electrode plates consisted of impregnated graphite with integrated cooling channels and incorporated inlets and outlets for the electrolyte solutions and cooling water. Mounted on the anode side were insulating plates composed of PVC and sealing frames composed of EPDM about 3 mm in thickness. The anodes were platinum foil strips disposed transversely on the insulating plate and in contact with the graphite supports laterally underneath the sealing frames. The two electrode chambers were separated by cation exchanger membranes of the type Nafion 450 (DuPont). The cathode chambers were incorporated into the supports in the form of parallel flow channels (4 mm deep). Since the cell had a height of 2 000 mm, the flow cross-sections of the anode chambers and cathode chambers were kept very small at about 1.5 $cm^2$, whereby high flow velocities were achievable along both electrodes. The volume of liquid in the cathode cycle was minimized to be able to realize very short residence times.

The following important technical data were adhered to:

| | |
|---|---|
| Anode area (platinum) | 300 $cm^2$ per electrode plate, for a total of 600 $cm^2$ |
| Cathode area (graphite) | 1 200 $cm^2$ per electrode plate, for a total of 2 400 $cm^2$ |
| Current strength | 2 × 150 A = 300 A current capacity |
| Current densities: | Anode 0.5 $A/cm^2$, cathode 0.12 $A/cm^2$ |
| Volume of catholyte cycle: | 2.5 l |
| Volume of anolyte cycle with dissolving vessel: | 6.5 l |
| Circulating volume of anolyte-catholyte | 400 l/h |
| Velocity along electrode surfaces | about 0.4 m/s |
| Number of circulations per hour: | Catholyte 160, anolyte 61.5 |
| The following amounts were metered: | |
| Catholyte: | 4.6 l/h of a solution with 95 g/l $Na_2SO_3$ |

-continued

| | |
|---|---|
| Gas in: | about 680 g/h $SO_2$ (time-based average) |
| Anolyte: | 3.6 l/h water with 0.15 g/l NaSCN |
| Dissolving vessel: | 2 000 g/h $Na_2SO_4$ |

The cooling of the cathode was adjusted so that the temperature in the circulating catholyte was about 35° C. and the anolyte came to a temperature of about 48° C. The cell voltage was 5.5 V (total voltage 11 V).

Following a start-up phase of about 6 h, a steady state was reached, at which point the following electrolyte quantities having the reported compositions were removed via the overflows at the electrolyte cycles under steady state conditions:

Anolyte: 4.1 l/h with 229 g/l $Na_2S_2O_8$+215 g/l $Na_2SO_4$+8 g/l $H_2SO_4$.

The average residence time for the anolyte cycle was about 95 min. The total yield of sodium peroxodisulfate was 939 g/h, which corresponds to a current yield of 70.5%.

| | |
|---|---|
| Catholyte: 5.4 l/h with the following composition: | 142 g/l $Na_2S_2O_4$<br>ca. 70 g/l $Na_2HSO_3$<br>ca. 20 g/l $Na_2SO_3$<br>ca. 10 g/l $Na_2S_2O_3$ |

The average residence time for the catholyte cycle was about 28 min. The total yield of sodium dithionite was 767 g/h, which corresponds to a current yield of 78.7%.

What is claimed is:

1. A process for the simultaneous preparation of sodium peroxodisulfate and sodium dithionite, which comprises, in electrolysis cells divided into two by a cation exchanger membrane, at current densities of from 1.5 to 6 $kA/m^2$ and temperatures of from 20 to 60° C., in aqueous solution, oxidizing sodium sulfate at the anode to give sodium peroxodisulfate, and preparing sodium dithionite at the cathode from the sodium ions liberated at the anode and converted by the cation exchanger membrane and introduced $SO_2$ at a pH of from 4 to 6.

2. The process as claimed in claim 1, wherein $Na_2SO_4$ and water are introduced into the circulating anolyte, and $SO_2$ and water are introduced into the circulating catholyte.

3. The process as claimed in claim 1, wherein sulfur dioxide and sodium sulfate are prepared in an upstream reactor from sodium sulfite or sodium bisulfite and sulfuric acid.

4. The process as claimed in claim 1, wherein use is made of anodes made of polished platinum or of valve metals niobium, tantalum, titanium or zirconium coated with platinum or diamond, and of cathodes made of carbon, stainless steel, silver or materials coated with platinum metals.

5. The process as claimed in claim 1, wherein anodes made of polished platinum are used and the ratio of the cathode surface area to the anode surface area is set between 1 and 4.

6. The process as claimed in claim 1, wherein flow rates along the electrodes are at least 0.1 m/s.

7. The process as claimed in claim 1, wherein the average residence time of the sodium dithionite formed in the catholyte cycle is set to a maximum of 30 min.

8. The process as claimed in claim 1, wherein potential-increasing additives such as sodium thiocyanate, sodium cyanamide, thiourea, fluoride, chloride inter alia are present in the anolyte.

9. The process as claimed in claim 1, wherein stabilizers such as phosphoric acid and/or phosphates are present in the catholyte.

10. The process as claimed in claim 1, wherein the anolyte removed from the system and containing sodium peroxodisulfate is worked up to obtain crystalline sodium peroxodisulfate.

11. The process as claimed in claim 1, wherein the catholyte removed from the system and containing sodium dithionite is worked up to obtain crystalline sodium dithionite.

12. The process as claimed in claim 1, wherein the anolyte and catholyte solutions removed from the system can be used directly as oxidizing or reducing bleach solutions.

* * * * *